US005271329A

United States Patent [19]

Blin et al.

[11] Patent Number: 5,271,329

[45] Date of Patent: Dec. 21, 1993

[54] IMPACT CONTACTOR PARTICULARLY FOR PROJECTILES WITH AN EXPLOSIVE CHARGE

[75] Inventors: André Blin, Mehun sur Yevre; Alain Bonnet, Bourges, both of France

[73] Assignee: Giat Industries, Cedex, France

[21] Appl. No.: 927,653

[22] PCT Filed: Jan. 9, 1992

[86] PCT No.: PCT/FR92/00012

§ 371 Date: Sep. 9, 1992

§ 102(e) Date: Sep. 9, 1992

[87] PCT Pub. No.: WO92/12523

PCT Pub. Date: Jul. 23, 1992

[30] Foreign Application Priority Data

Jan. 9, 1991 [FR] France ..... 91 00181

[51] Int. Cl.[5] ..... F42C 19/06; H01H 35/02

[52] U.S. Cl. ..... 102/216; 102/273; 200/61.45 R; 200/61.53

[58] Field of Search ..... 102/216, 262, 273; 200/61.45 R, 61.53

[56] References Cited

U.S. PATENT DOCUMENTS

| | | | |
|---|---|---|---|
| 2,980,773 | 4/1961 | Leaman et al. . | |
| 3,038,973 | 6/1962 | Alpert | 200/61.45 |
| 3,783,791 | 1/1974 | Backstein et al. | 200/61.45 |
| 3,909,568 | 9/1975 | Greenhug . | |

FOREIGN PATENT DOCUMENTS

| | | |
|---|---|---|
| 79714 | 12/1962 | France . |
| 2564236 | 11/1985 | France . |

*Primary Examiner*—Harold J. Tudor
*Attorney, Agent, or Firm*—Oliff & Berridge

[57] ABSTRACT

Triggering a pyrotechnic charge. The contactor comprises:

a supporting base (6), made of insulating material, having at least two conducting terminals (7 and 8), a contact sleeve (13) centered coaxially on the base, in contact with one of the terminals and having fingers urged centrifugally by elastic elements (22), a deformable conducting case (24) in contact with the second terminal, and a conducting slide (28) movable by inertia on the axis of symmetry against the action of a retaining spring (31).

Application as an impact contactor for projectiles.

9 Claims, 1 Drawing Sheet

IMPACT CONTACTOR PARTICULARLY FOR PROJECTILES WITH AN EXPLOSIVE CHARGE

BACKGROUND OF THE INVENTION

The present invention falls within the technical domain of the triggering and setting off or explosion of a pyrotechnic charge in relation to an impact between a target and a projectile.

The invention aims in particular at setting off or exploding an explosive charge using an electrical energy source, generally on board, for triggering a detonator.

As an example of its application, the invention aims to trigger, on impact, the explosive charge of preferably large-caliber ammunition.

Projectiles are known that have explosive charges whose triggering is controlled by the operation of a detonator, supplied with electrical current from a storage source, generally consisting of one or more capacitors.

Closing of the electrical supply circuit of the detonator is made to depend on the operation of an impact contactor situated at the front of the projectile.

In order for triggering to occur on impact in a reliable fashion, a certain number of variable factors must be taken into account which could counteract triggering or, on the contrary, promote it inadvertently. These factors are the various possible angles of incidence of the trajectory of the projectile relative to the target, the resistance properties of the target, and also possible vegetation that the projectile may be made to pass through in the course of its ballistic trajectory.

SUMMARY OF THE INVENTION

The object of the invention is to propose an impact contactor that is in fact designed to take into account these variable factors, so that the triggering of the explosive charge, on impact, does not occur during passage through more or less dense vegetation, but still of a light nature, but on the contrary definitely does occur, obviously in the event of frontal impact, but also on impact at any angle of incidence relative to the perpendicular to the target, which can be as much as 80°, or even more.

To achieve the above objective, the impact contactor according to the invention is characterized by having:

- a support base of insulating material with at least two conducting terminals defining an axis of symmetry,
- a contact sleeve centered coaxially on the base, in contact with one of the terminals and having, in a plane transverse to the axis of symmetry, contact fingers or pins, in electrical contact with the sleeve, mounted to slide freely radially with respect to the axis and urged to move centrifugally by resilient components against an insulating sheath slipped over the outside of the sleeve,
- a conducting, flexible case, in contact with the second terminal, held at a distance from the sleeve, but fixed to the base by means of the insulating sheath,
- and a conducting slide, movable by inertia on the axis of symmetry against the action of a retaining spring, guided in the base, held in continuous electrical contact with the case and able to cooperate with the fingers.

Various other characteristics will be apparent from the following description with reference to the attached drawings which show, as a non-limiting example, one embodiment of the object of the invention.

DESCRIPTION OF PREFERRED EMBODIMENTS

Figure 1:
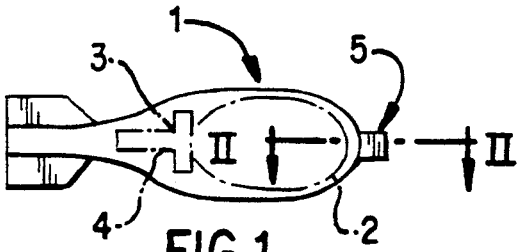
FIG. 1 is a schematic view illustrating the application of the object of the invention.

FIG. 1 shows and explosive projectile 1, preferably of large caliber, containing an explosive charge 2 set off or exploded by a detonator 3 supplied with electrical current from a source 4 which can be one or more capacitors charged by means of a piezoelectric-type generator activated by inertia on departure or launching of projectile The current to detonator 3 from source 4 is provided by an electrical circuit, not shown in the drawings, completion of which is controlled by an impact contactor 5 fitted into the front part of projectile 1.

Figure 2:
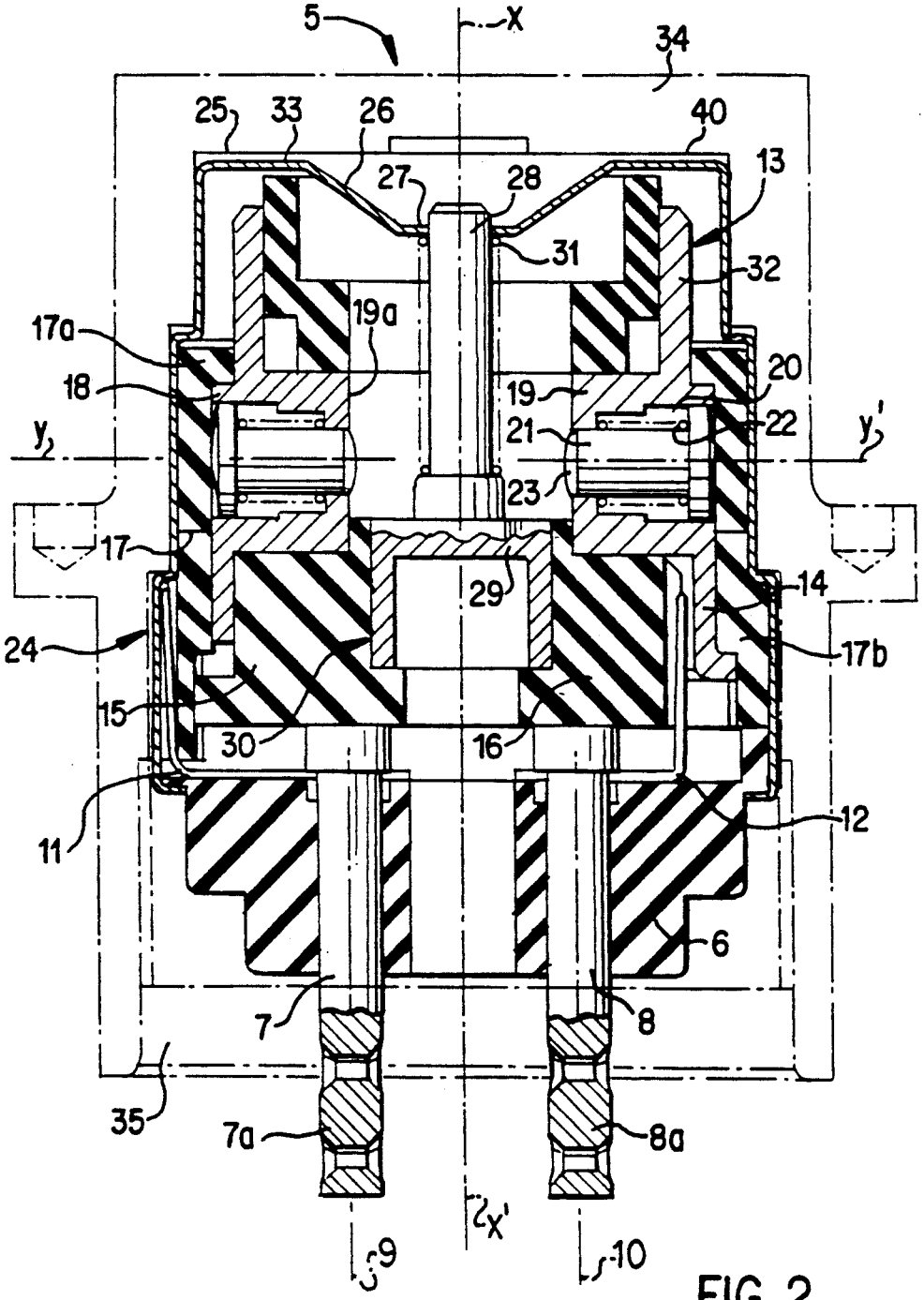
FIG. 2 is an axial section through the impact contactor according to the invention.

FIG. 2 shows an elevation of impact contactor 5 comprising a base 6 of insulating material with means for adaptation to the body of projectile. Base 6 has at least two contact terminals 7 and 8 passing through it, said terminals having end portions 7*a* and 8*a* connected to two conductors 9 and 10 which form part of the electrical circuit established between detonator 3 and current source 4. Preferably, base 6 is made in the form of a body with an external profile of revolution with an axis of symmetry x—x'.

Terminals 7 and 8 can be mounted individually in or on base 6 or base 6 can be molded directly over these terminals. Various ways of creating the terminals can thus be used without being considered as depending essentially on the invention. In any event, terminals 7 and 8 are preferably extended by two elastically flexible blades 11 and 12 which extend, for example, essentially parallel to the axis of symmetry or of revolution x—x' and opposite parts 7*a* and 8*a*.

The impact contactor has in addition, a sleeve 13 of conducting metal which is slipped over an alignment 15 of base 6 by means of a skirt 14 which it delimits. Alignment 15 can be formed directly by base 6 or preferably by an adapter 16 of insulating material mounted coaxially on base 6. The structure of adapter 16 is defined so that one of the blades, for example blade 12, is brought into contact with skirt 14, while the second blade, for example blade is spaced apart from and insulated from the sleeve. This can be accomplished by means of an insulating sheath 17 slipped over the exterior of skirt 14 of sleeve 13 which has, for this purpose, a support shoulder 18. Sheath 17 can be made in one piece or can be composed of two rings 17*a* and 17*b*.

On the inside, sleeve 13 forms a thick crown 19 which demarcates in a transverse plane y—y' perpendicular to axis x—x', D recesses 20 in a radial direction, which can be even in number arranged at equal angles apart and diametrically opposite each other or possibly odd in number. Each recess 20 has a finger or pin 21 free to slide in radial recess 20 and be urged centrifugally against sheath 17 by means of an elastic element 22. Fingers 21 are held in continuous electrical contact with the sleeve by friction in their recesses and by contact with elastic elements 22. Sliding fingers 21 are thus normally situated in a stable state of retraction in which their internal ends 23 are flush with internal peripheral wall 19*a* of crown 19.

Base assembly 6, and possibly adapter 16, sleeve 14, and sheath 17, are held together in a coaxial arrangement by a case 24 crimped on base 6 and sheath 17 to maintain a continuous electrical contact between itself and blade 11 of terminal 7.

Case 24, in the form of a thin tubular cylinder, has a front end portion designed to extend at a distance from and without contact with conducting sleeve 13. The end part has a front wall 25 which has, for example, a depression 26 ensuring, by any suitable means and especially by means of an opening 27 centered on axis x—x', guidance of a movable slide 28 made of a conducting metal. Slide 28 has a foot 29 with a greater transverse cross section, which is guided inside a well 30 made coaxially in base 6 and, especially in the example shown, in adapter 16. Foot 29 has a cylindrical section with a diameter smaller than the section of the passage defined by internal peripheral wall 19*a* of crown 19. Slide 28 is associated with an elastic retainer 31, for example composed of a coil spring mounted under tension between depression 26 and foot 29, to keep this foot inside well 30, in an unobtrusive position relative to transverse plane y—y' and especially relative to recesses 20 of fingers 21. It should be noted that fingers 21 are of a length such that they can never come into contact with slide 28 in the stable unobtrusive position of foot 29, even in the event of maximum axial force against the action of springs 22. On the other hand, the length of fingers 21 is chosen so that they can be brought into contact with foot 29 when it is at least partially extended.

Sleeve 13 preferably has, opposite skirt 14, a tubular part 32 in which a tubular brace 33 is centered, resting against crown 19 to act as a stop for front wall 25 during handling, mounting, storage, etc. Brace 33 is made of an insulating material with a relatively low crush resistance.

The contactor according to the invention is completed by a cap 34 of a relatively hard material, with a certain thickness, on the one hand to protect and properly shelter the various constituent components of the contactor from inadvertent shocks and blows which could be dealt to it either when it is handled alone or during handling of projectile 1 on which it is mounted and on the other hand to ensure that the electrical circuit is not completed when the projectile passes through branches. Cap 34 has for example, a thread 35 by which it is screwed to the body of projectile 1 on which the impact contactor is fitted.

As can be seen from the above and from examination of FIG. 2, conductor 9 is connected to a first internal circuit of the contactor by means of terminal 7, blade 11, case 24, and even slide 28, while second conductor 10 is electrically connected to a second internal circuit formed by terminal 8, blade 12 and sleeve 13, and even fingers 21.

In the situation illustrated in FIG. 2, the two internal circuits are separate and ensure a break in the supply circuit between source 4 and detonator 3.

Operation of the impact contactor described above occurs as follows.

Assuming that on its ballistic trajectory projectile 1 traverses more or less dense vegetation which is nevertheless of a light nature, the impacts against the branches are absorbed by cap 34, without this cap undergoing elastic and/or plastic deformation. Cap 34 thus protects the front part of case 24 which is protected from any risk of deformation or crushing.

None of the constituent components of the impact contactor undergo a change of state or position that would close the electrical circuit between conductors 9 and 10.

Assuming that a frontal impact occurs with a branch involving kinetic energy greater than the compression resistance of spring 31, slide 28 tends to move a short distance, without any resulting direct or indirect contact with sleeve 13. Thus inadvertent triggering cannot occur.

Assuming that impact with a branch occurs at a given angle of incidence, springs 22 could allow centripetal radial sliding of some fingers 21, simultaneously with a relative axial movement of slide 28, as described above. However, it must be noted that the stiffness of springs 22 and 31 is chosen so that at such contact with branches, the relative displacements of fingers 21 and slide 28 are of sufficiently small amplitude that fingers 21 do not come into contact with foot 29.

At the moment of impact of projectile 1 with a target, cap 34 is crushed thereby crushing the front part of conducting case 24. By deformation and/or crushing of brace 33, case 24 is brought into contact with tubular part 32, at least, of sleeve 13, completing the circuit between conductors 9 and 10.

Thus, on impact, source 4 is connected to detonator 3 which is charged by the electrical current received, to set off or cause the explosion of charge 2.

In the event of impact at a given angle of incidence between axis x—x' and the perpendicular to the plane of the target, operation of the contactor could occur in exactly the same way as described above. If the angle of incidence is relatively large, for example close to 90° relative to the perpendicular to the target and the target is consequently struck not directly by contactor 5 but by another part of the projectile, the kinetic energy of impact causes slide 28 to move translationally against the action of spring 31. Simultaneously and by resolution of the forces, at least one of the fingers or pins 21 is urged to move centripetally against the action of corresponding retaining spring 22. The relative displacements of the slide 28 and at least one finger 21 establish surface contact between one of these fingers and foot 29 and consequently complete, by means of case 24, slide 28 and a finger 21, the circuit between terminals 7 and 8 to establish a current supply for detonator 3.

Operation is therefore certain to occur no matter what the conditions of impact, without inadvertent triggering while passing through vegetation or branches.

As will be seen from examination of FIG. 2, the impact contactor consists of stackable elementary components that can be assembled axially and held together by crimping of case 24. Such a contactor can therefore be produced at low cost, on elementary production lines and by automated assembly. To this end, a hole 40 could be made in front wall 25 of case 24, so that after preassembly of at least some of the component elements of the contactor, the integrity of the electrical circuit between the various assembled components can be tested.

The invention is not limited to the example described and illustrated, because various modifications can be made thereto without departing from its scope.

We claim:

1. An impact contactor for completing an electrical supply circuit, comprising:

a support base of insulating material, having at least first and second conducting terminals and defining an axis of symmetry;

a contact sleeve coaxially centered on the base, in contact with the first conducting terminal and having, in a plane transverse to the axis of symmetry, conducting fingers in electrical contact with the sleeve, said fingers being mounted to slide freely radially relative to the axis and urged to move centrifugally by resilient elements against an insulating sheath disposed over the outside of the sleeve;

a deformable conducting case in contact with the second terminal, said conducting case being spaced apart from the sleeve while being fixed to the base by means of the insulating sheath; and a conducting slide, movable by inertia on the axis of symmetry against the action of a retaining spring, the retaining spring being disposed around the conducting slide and between the deformable conducting case and a second part of the conducting slide, a first part of the conducting slide being guided by the case and said second part of the conducting slide being guided in the base, the conducting slide being in continuous electrical contact with the deformable conducting case.

2. Impact contactor according to claim 1, wherein the second part of the conducting slide is a cylindrical contact foot, the sleeve comprising a crown internally demarcating a section of a passage above a transverse cross section of the cylindrical contact foot, said contact foot having a diameter greater than that of the first part of the slide, said slide being guided int he base and held by the retaining spring in an unobtrusive position relative to the fingers.

3. Impact contactor according to claim 1, wherein the fingers are of such a length that in a centripetally extended position they can only come into contact with the foot of the slide.

4. Impact contactor according to claim 1, wherein said first and second terminals comprise two elastically flexible blades, one of which is kept in contact with the sleeve and the other, insulated from the sleeve by the sheath, is kept in contact with the case, said case being crimped on to the base and the sheath.

5. Impact contactor according to claim 1, wherein the sleeve is composed of a conductive body of revolution with a skirt encasing an alignment of the base and forming an external support shoulder for the insulating sheath.

6. Impact contactor according to claim 1, wherein the sleeve comprises, opposite a skirt, a tubular part in which an insulating tubular brace is enclosed, the insulating tubular brace extending axially beyond the sleeve and resting against a crown of the tubular part to act as a stop for a front wall of the case during handling.

7. Impact contactor according to claim 1 wherein the sleeve comprises, in its essentially transverse median portion, a thick crown in which radial recesses are made that contain the fingers.

8. Impact contactor according to claim 1, wherein the sheath comprises two parts and said base supports an independent insulating part forming an alignment for a skirt and a well for guiding said foot.

9. Impact contactor according to claim 1, wherein said case is covered by a cap of a resistant material, said cap ensuring adaptation of the contactor to a body.

* * * * *

UNITED STATES PATENT AND TRADEMARK OFFICE

CERTIFICATE OF CORRECTION

PATENT NO. : 5,271,329

DATED : December 21, 1993

INVENTOR(S) : Andre BLIN and Alain BONNET

It is certified that error appears in the above-identified patent and that said Letters Patent is hereby corrected as shown below:

ON THE COVER PAGE:

[57] ABSTRACT

Please substitute the Abstract with the following Abstract.

--ABSTRACT

An impact contactor for use with projectiles having an explosive charge has a support base of insulating material with at least two conducting terminals defining an axis of symmetry. A contact sleeve is centered coaxially on the base in contact with one of the terminals and has in a plane transverse to the axis of symmetry contact fingers or pins in electrical contact with the sleeve. The contact fingers are mounted to slide freely radially with respect to the axis and are urged to move centrifugally by resilient components against an insulating sheath slipped over the outside of the sleeve. A conducting, flexible case, in contact with the second terminal is held at a distance from the sleeve, but fixed to the base by the insulating sheath. A conducting slide cooperates with the fingers and

UNITED STATES PATENT AND TRADEMARK OFFICE

CERTIFICATE OF CORRECTION

PATENT NO. : 5,271,329

DATED : December 21, 1993

INVENTOR(S) : Andre BLIN and Alain BONNET

It is certified that error appears in the above-identified patent and that said Letters Patent is hereby corrected as shown below:

is movable by inertia on the axis of symmetry against the action of a retaining spring that is guided in the base. The slide is held in continuous electrical contact with the case.--

Signed and Sealed this

Twenty-eight Day of February, 1995

*Attest:*

Bruce Lehman

BRUCE LEHMAN

*Attesting Officer*

*Commissioner of Patents and Trademarks*